US008015912B2

(12) United States Patent
Stimpson et al.

(10) Patent No.: US 8,015,912 B2
(45) Date of Patent: Sep. 13, 2011

(54) DIAPHRAGM PUMP HAVING A TWIST AND LOCK FASTENER

(75) Inventors: Robert William Stimpson, British Isles (GB); Yanchun Wang, British Isles (GB)

(73) Assignee: DLP Limited, Isle of Man, British Isles (GB)

( * ) Notice: Subject to any disclaimer, the term of this patent is extended or adjusted under 35 U.S.C. 154(b) by 239 days.

(21) Appl. No.: 12/091,762

(22) PCT Filed: Nov. 2, 2006

(86) PCT No.: PCT/GB2006/004086

§ 371 (c)(1), (2), (4) Date: Apr. 28, 2008

(87) PCT Pub. No.: WO2007/054667

PCT Pub. Date: May 18, 2007

(65) Prior Publication Data

US 2008/0292477 A1 Nov. 27, 2008

(30) Foreign Application Priority Data

Nov. 9, 2005 (GB) ..... 0522845.7
Jan. 19, 2006 (GB) ..... 0601040.9

(51) Int. Cl.
*F16J 3/02* (2006.01)
*F01B 19/02* (2006.01)

(52) U.S. Cl. ..... 92/99; 417/413.1

(58) Field of Classification Search ..... 417/362, 417/413.1; 92/96, 98 R, 100, 102, 99
See application file for complete search history.

(56) References Cited

U.S. PATENT DOCUMENTS 3,021,792 A * 2/1962 Johnson et al. ..... 92/94
3,420,578 A 1/1969 Lewis
5,743,169 A * 4/1998 Yamada ..... 92/100
5,996,470 A * 12/1999 Eady et al. ..... 92/99
6,065,389 A 5/2000 Riedlinger
6,883,417 B2 * 4/2005 Headley et al. ..... 92/99
7,284,965 B2 10/2007 Adahan
7,758,539 B2 7/2010 Adahan (Continued)

FOREIGN PATENT DOCUMENTS

DE 3529978 A1 * 3/1987

(Continued)

OTHER PUBLICATIONS

Machine Translation of DE3529978A1.*

(Continued)

*Primary Examiner* — Devon C Kramer
*Assistant Examiner* — Nathan Zollinger
(74) *Attorney, Agent, or Firm* — Martin Fleit; Paul D. Bianco; Fleit Gibbons Gutman Bongini & Bianco PL

(57) ABSTRACT

A diaphragm pump for a pumped shower waste, comprises a diaphragm housing (12), a diaphragm (34) removably held in the diaphragm housing (12), an openable cover (16) on the diaphragm housing (12) for accessing the diaphragm (34), an electric motor (14), a connecting member (40) positioned in the diaphragm housing (12) and movable by the electric motor (14), and a non-screw-threaded twist and lock fastener (62) which releasably engages the diaphragm (34) with the connecting member (40). The diaphragm (34) can thus be disengaged and removed from the connecting member (40) without the use of a screwdriver.

9 Claims, 10 Drawing Sheets

U.S. PATENT DOCUMENTS

| | | | | |
|---|---|---|---|---|
| 2004/0182237 | A1 | 9/2004 | Headley et al. | |
| 2004/0208756 | A1 | 10/2004 | Adahan | |
| 2006/0065244 | A1* | 3/2006 | Norcutt et al. | 123/470 |
| 2007/0031268 | A1 | 2/2007 | Adahan | |
| 2007/0136943 | A1* | 6/2007 | Long | 4/622 |
| 2007/0166180 | A1 | 7/2007 | Adahan | |
| 2007/0278145 | A1* | 12/2007 | Taylor et al. | 210/321.6 |

FOREIGN PATENT DOCUMENTS

| | | | |
|---|---|---|---|
| EP | 1 460 270 | A2 | 9/2004 |
| GB | 1 269506 | A | 4/1972 |
| GB | 1 356 485 | A | 6/1974 |
| GB | 2 378 734 | A | 2/2003 |
| GB | 0522845.7 | | 11/2006 |
| WO | WO2005/085639 | A1 | 9/2005 |

OTHER PUBLICATIONS

Human Translation of DE3529978.*
International Search Report for PCT/GB06/04086.
International Preliminary Examination Report for PCT/GB06/04086.
Written Opinion for PCT/GB06/04086.
British Search Report for PCT/GB06/04086.

* cited by examiner

DIAPHRAGM PUMP HAVING A TWIST AND LOCK FASTENER

FIELD OF THE INVENTION

The present invention relates to a diaphragm pump, particularly but not exclusively for use with a pumped shower waste.

BACKGROUND OF THE INVENTION

Diaphragm pumps per se are well known. However, the diaphragm is relatively weak and requires replacing once it reaches the end of its operational life. The diaphragm is typically held to a connecting rod, driven by an electric motor, by a machine screw and large diameter washer. To replace the diaphragm, a diaphragm housing in which the diaphragm is held is first opened, and then the screw is removed by typically, a screwdriver providing the screw has a suitable recess in its head. The diaphragm can then be removed from the housing, and replaced. The screw with washer is reinserted through the connecting rod into a nut located on the inner surface to reengage and retain the diaphragm with the connecting rod.

However, a significant problem is encountered by installers and maintenance workers in that the diaphragm pump itself is often located in awkward, hard to reach places, such as under flooring, between joists, and in corners. This makes it complicated to insert and correctly orientate tools, and it is also often difficult to find a suitable purchase to enable release of the screw and washer.

Moreover, once released, it is difficult to extract the screw and washer without them being fumbled and lost in the space around the pump, or to reliably retain the backing nut in position.

Re-engagement of the screw, after replacement of the diaphragm, can be equally as difficult.

The present invention seeks to provide a solution to this problem.

SUMMARY OF THE INVENTION

According to the present invention, there is provided a diaphragm pump for a pumped shower waste, the pump comprising a diaphragm housing, a diaphragm removably held in the diaphragm housing, an openable cover on the diaphragm housing for accessing the diaphragm, an electric motor, a connecting member positioned in the diaphragm housing and movable by the electric motor, and a non-screw-threaded twist and lock fastener which releasably engages the diaphragm with the connecting member, so that, when removal is required, the diaphragm can be disengaged from the connecting member without the use of a screwdriver.

Preferable and/or optional features of the present invention are set forth below.

BRIEF DESCRIPTION OF THE DRAWINGS

The invention will now be more particularly described, by way of example only, with reference to the accompanying drawings, in which.

DETAILED DESCRIPTION OF THE INVENTION

Figure 1:
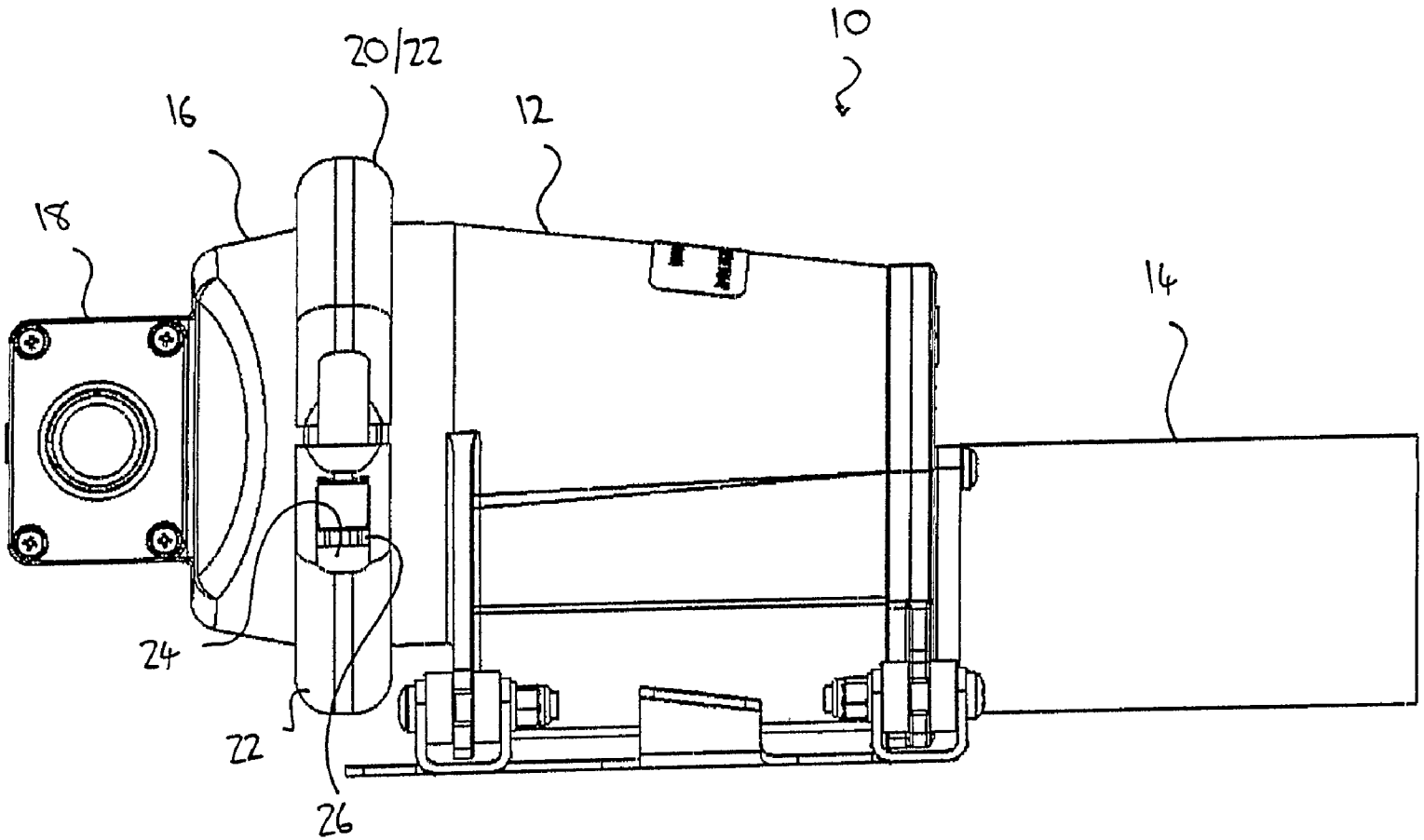
FIG. 1 is an elevational side view of one embodiment of a diaphragm pump, in accordance with the present invention.
Figure 2:
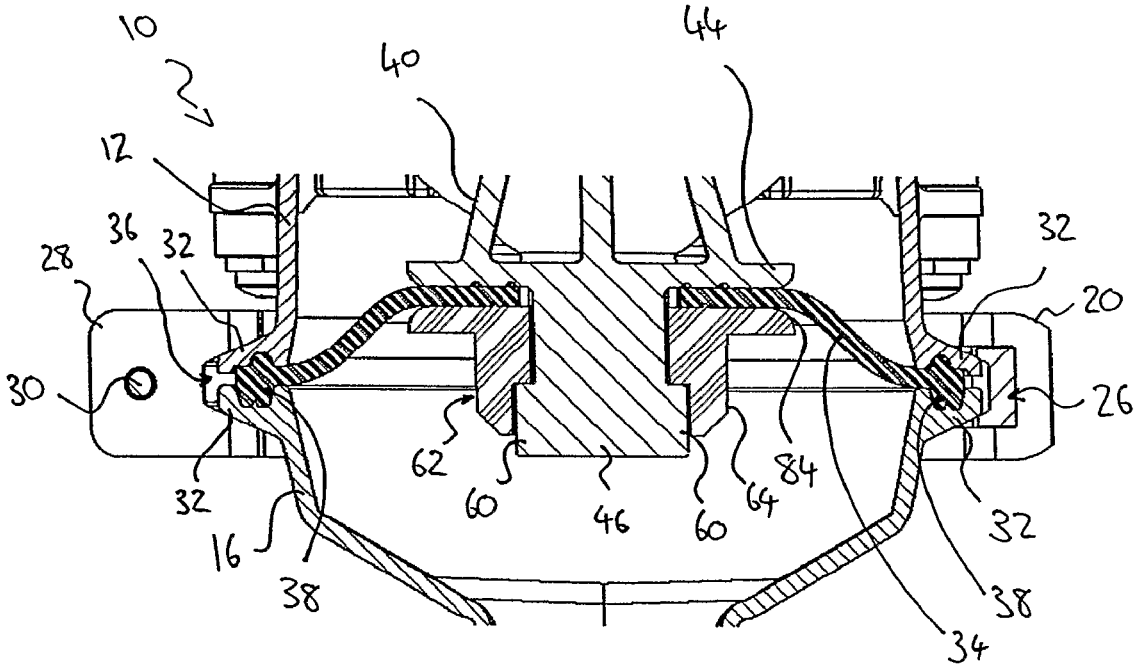
FIG. 2 is a scrap view from above, in cross-section, of a cover engaged with a housing of the pump and a diaphragm located within the housing.
Figure 3:
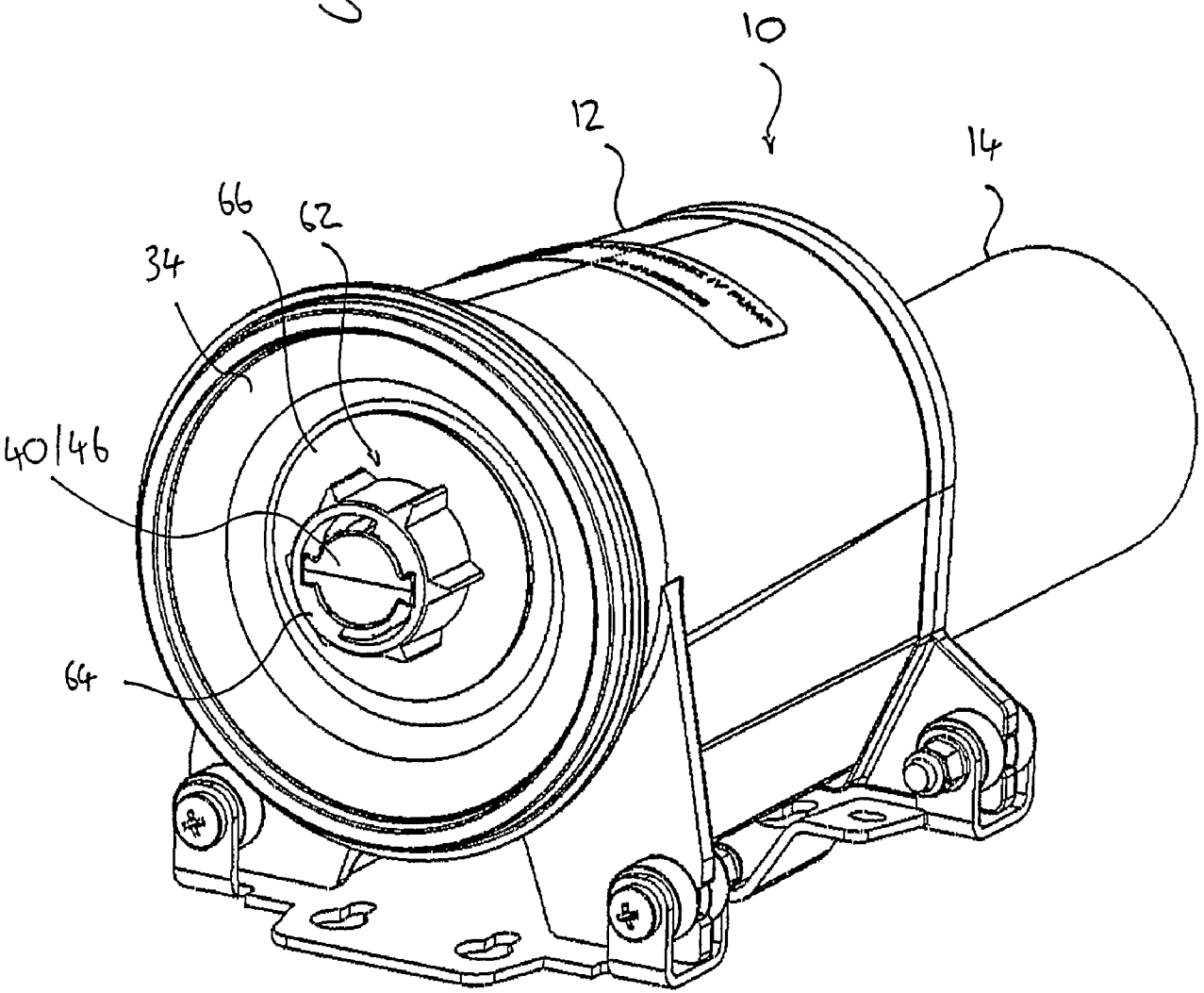
FIG. 3 is a perspective view of the pump shown in FIG. 1, with the cover removed and showing the diaphragm.

Referring firstly to FIGS. 1 to 3 of the drawings, there is shown a diaphragm pump 10 which comprises a diaphragm housing 12 having an electric motor 14 mounted at the rear of the housing 12 and an openable cover 16 closing the front of the housing 12. A valve body 18 is located on the front of the cover 16 for connection to pipework. The valve body 18 is in fluid communication with the interior of the diaphragm housing 12 through the cover 16. The valve body 18 is described in detail in British patent application GB0522845.7, and thus further description is omitted.

The cover 16 is releasably attached to the diaphragm housing 12 by a two-part ring clamp 20 or similar device. The ring clamp 20 includes two arcuate elements 22 which in use extend in a circumferential direction around the top and bottom of the diaphragm housing 12. One end of one of the arcuate elements 22 includes a hook 24, and one end of the other arcuate element includes an opening 26 for receiving the hook 24. The other ends of the arcuate elements 22 have tabs 28, each with an aperture 30. To close the ring clamp 20, the hook 24 and opening 26 are engaged, the tabs 28 are aligned, and a screw-threaded fastening device (not shown), such as a nut and bolt, is located in the apertures 30 to fasten the tabs 28 together.

The cover 16 and diaphragm housing 12 include complementarily shaped circumferential outwardly extending perimeter flanges 32 between which a, typically thermoplastic elastomer, diaphragm 34 is trapped. The two arcuate elements 22 of the ring clamp 20 include channels 36 in which the cover 16 and diaphragm housing flanges 32 can be received as a tight fit. Consequently, when closed, the ring clamp 20 urges the flanges 32 of the cover 16 and the diaphragm housing 12 together, to fluid-tightly clamp a perimeter edge 38 of the diaphragm 34 therebetween.

With the ring clamp 20 released and the cover 16 removed, the diaphragm 34 is exposed, as can be seen in FIG. 3.

Figure 5:
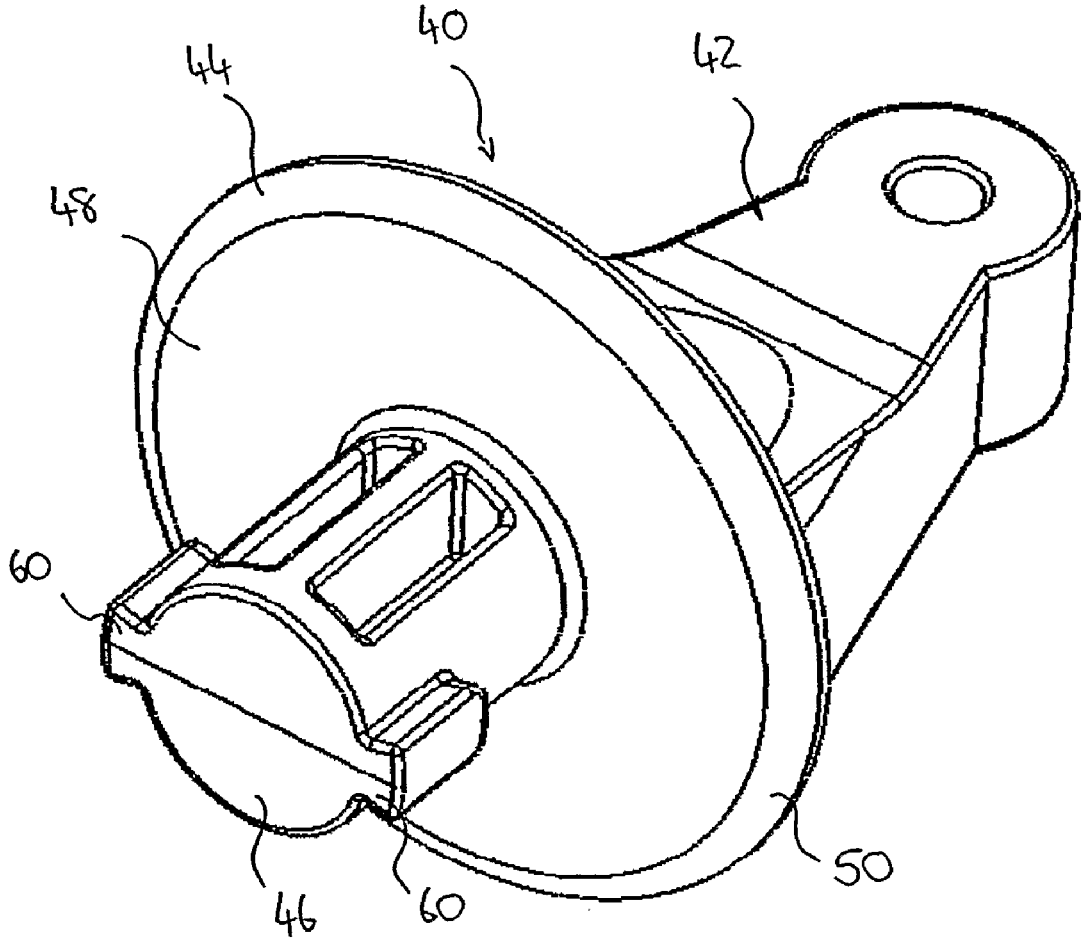
FIG. 5 is a perspective view of a connecting member which interconnects an electric motor drive gear train of the pump with the diaphragm.
Figure 6:
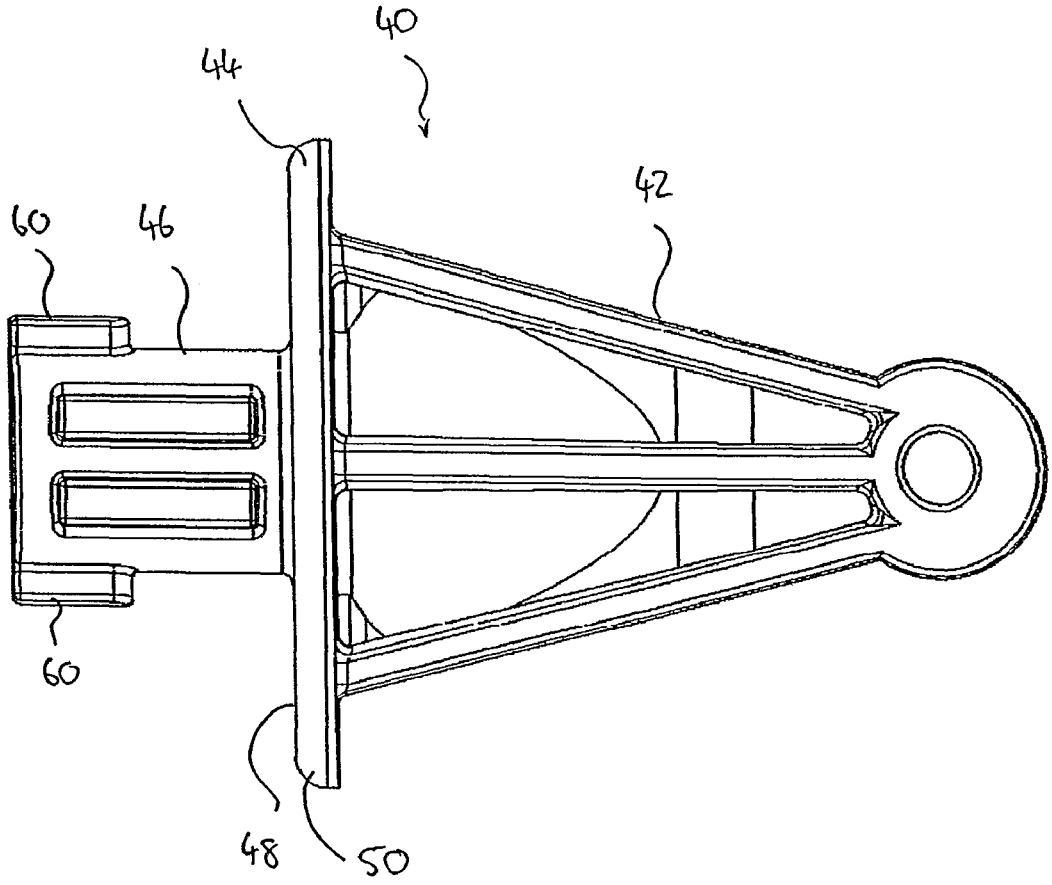
FIG. 6 is a plan view of the connecting member.

The diaphragm pump 10 also includes a, typically moulded plastics, connecting member 40, which is connected to a drive gear train mechanism (not shown) connected to an output shaft (not shown) of the electric motor 14 and which extends through the diaphragm housing 12 to engage the diaphragm 34. As best seen in FIGS. 5 and 6, the connecting member 40 includes a substantially triangular body 42, a circular diaphragm plate 44 at one end of the triangular body 42, and a spigot 46 which is formed centrally on the diaphragm plate 44 and which projects away from the triangular body 42.

The diaphragm plate 44 of the connecting member 40 has a smooth planar face 48 which, in use, contacts the diaphragm 34, and the smooth face 48 includes a smoothly radiused perimeter edge 50 to prevent abrasion and chafing of the diaphragm 34.

Figure 4:
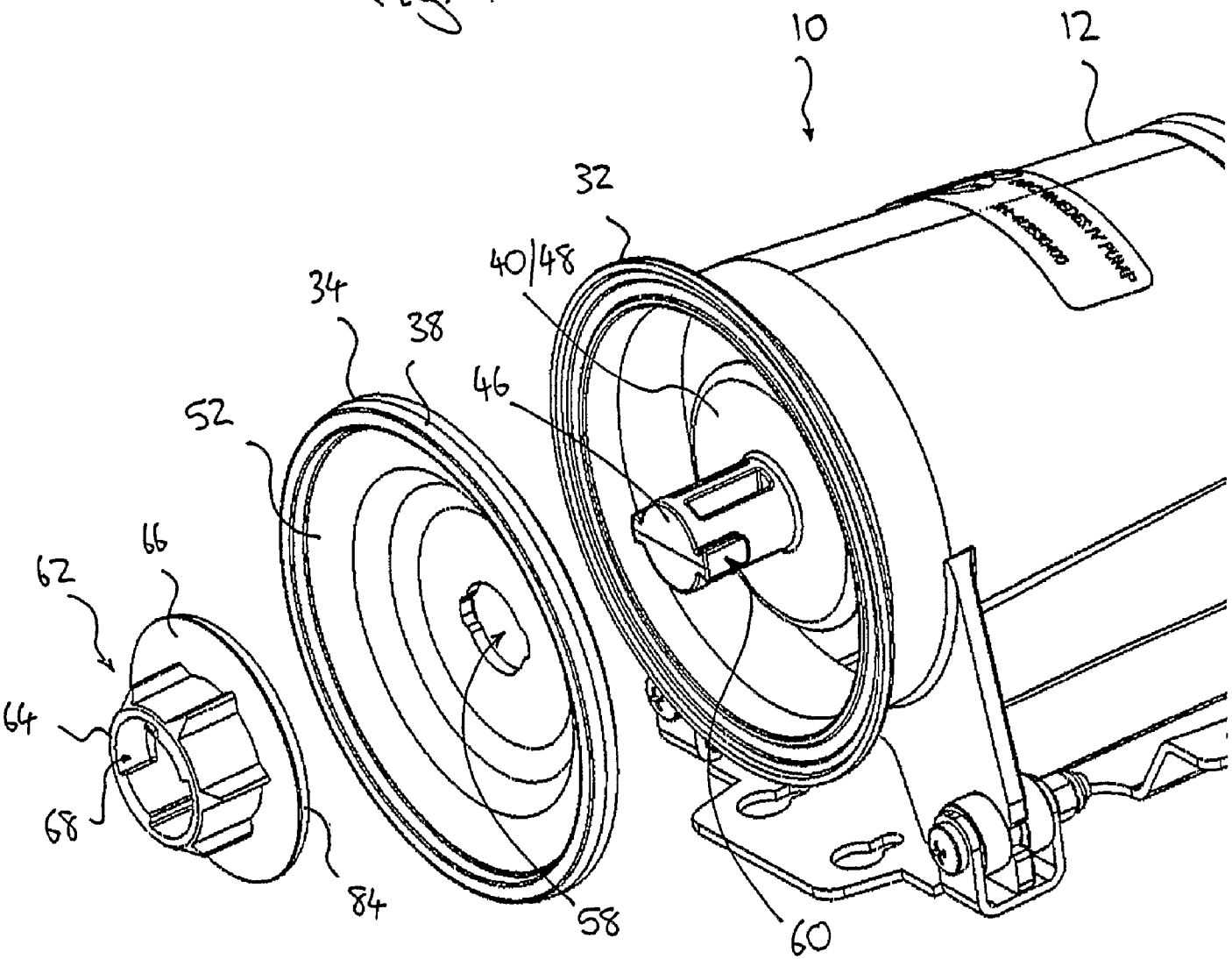
FIG. 4 is an exploded perspective view, similar to FIG. 3, showing a fastener and the diaphragm removed from the housing.
Figure 7:
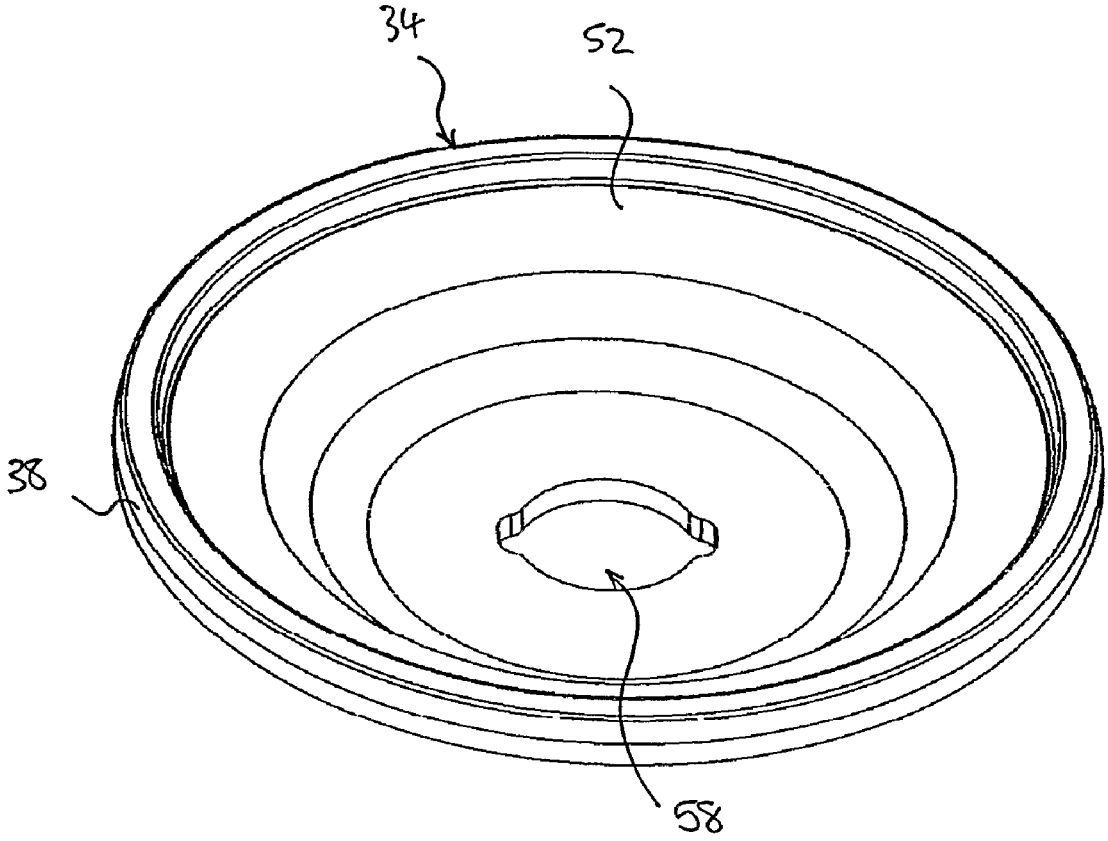
FIG. 7 is a perspective view of the diaphragm, from the front.
Figure 8:
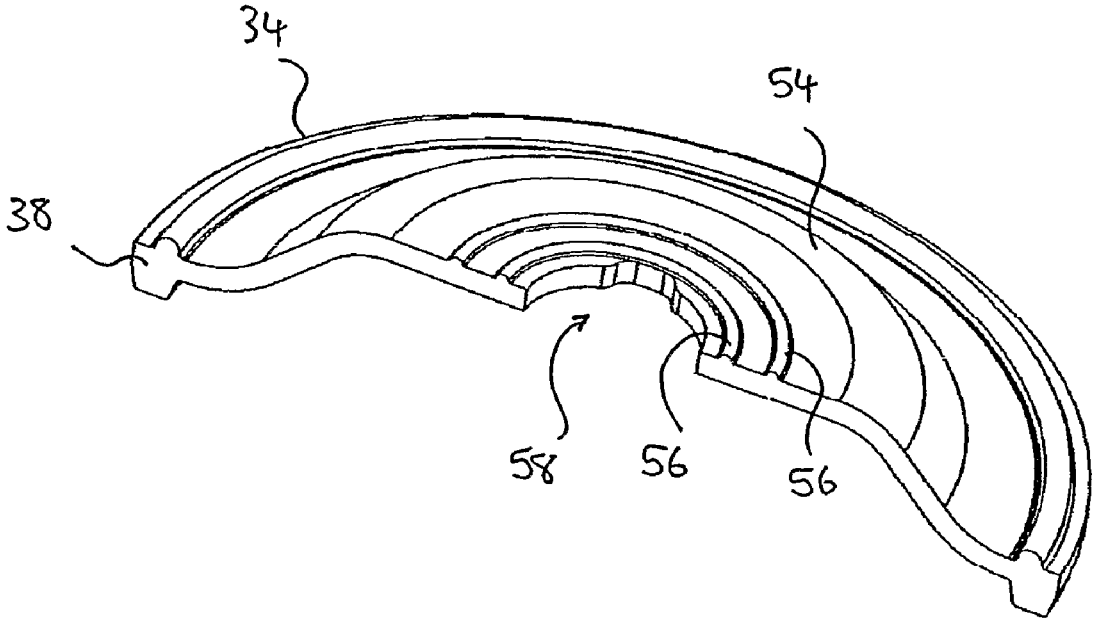
FIG. 8 is a sectional view of the rear of the diaphragm, taken along the diameter.

As understood from FIGS. 4, 7 and 8, the diaphragm 34 is generally dished, with the front face 52 opposite the cover 16 being typically concave when the pump 10 is deenergised or when the diaphragm 34 is removed from the pump 10. The rear face 54 of the diaphragm 34 opposite the front face 52 includes two concentric arcuate, typically ring shaped, sealing ridges 56 positioned around a central diaphragm aperture 58. The diaphragm aperture 58 receives the spigot 46 of the connecting member 40. The spigot 46 is generally cylindrical and includes two diametrically opposite bayonet or wing elements 60. Each wing element 60 projects radially outwardly and has a generally dovetailed lateral cross-sectional shape.

Figure 9:
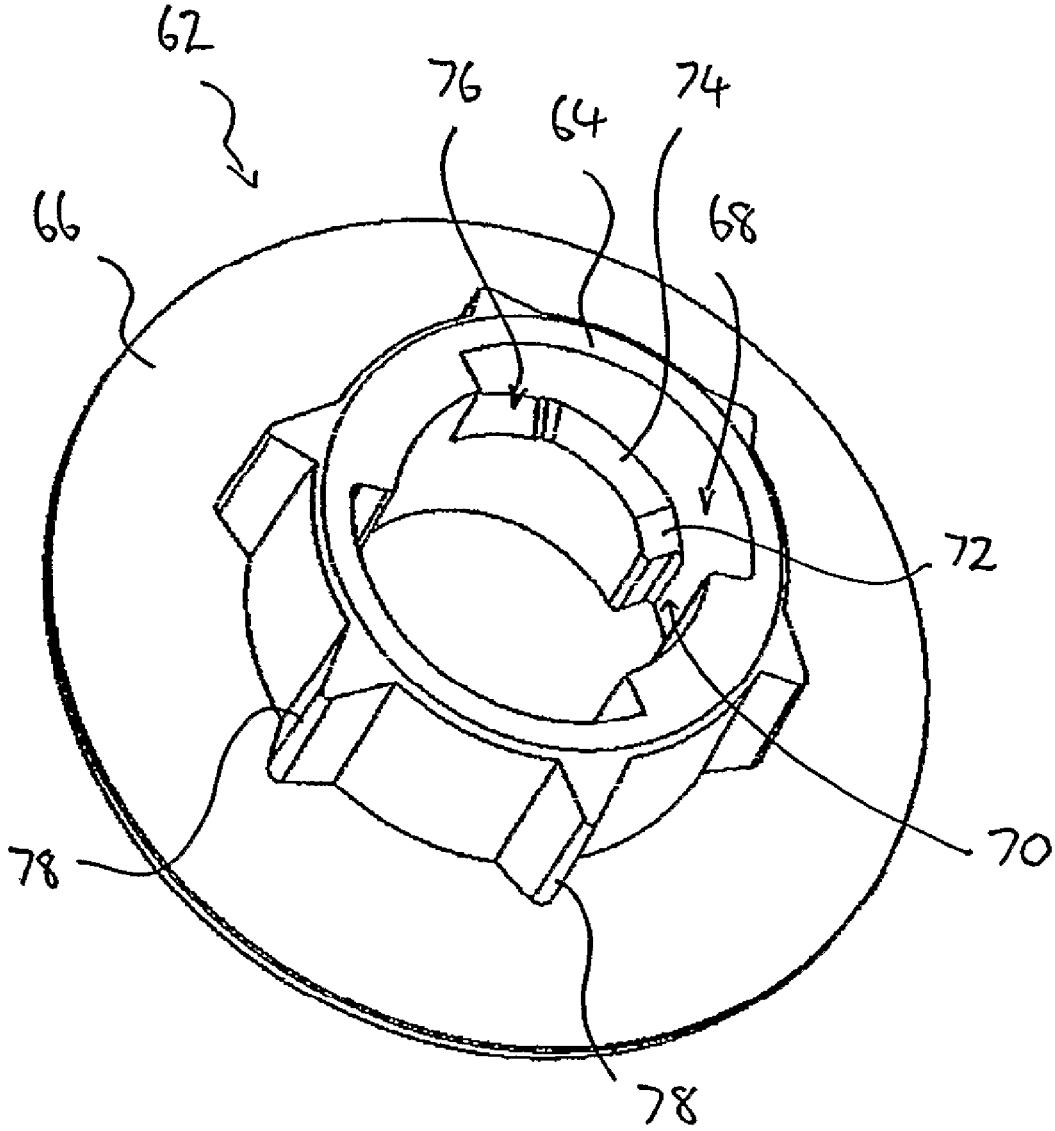
FIG. 9 is a perspective front view of the fastener.
Figure 10:
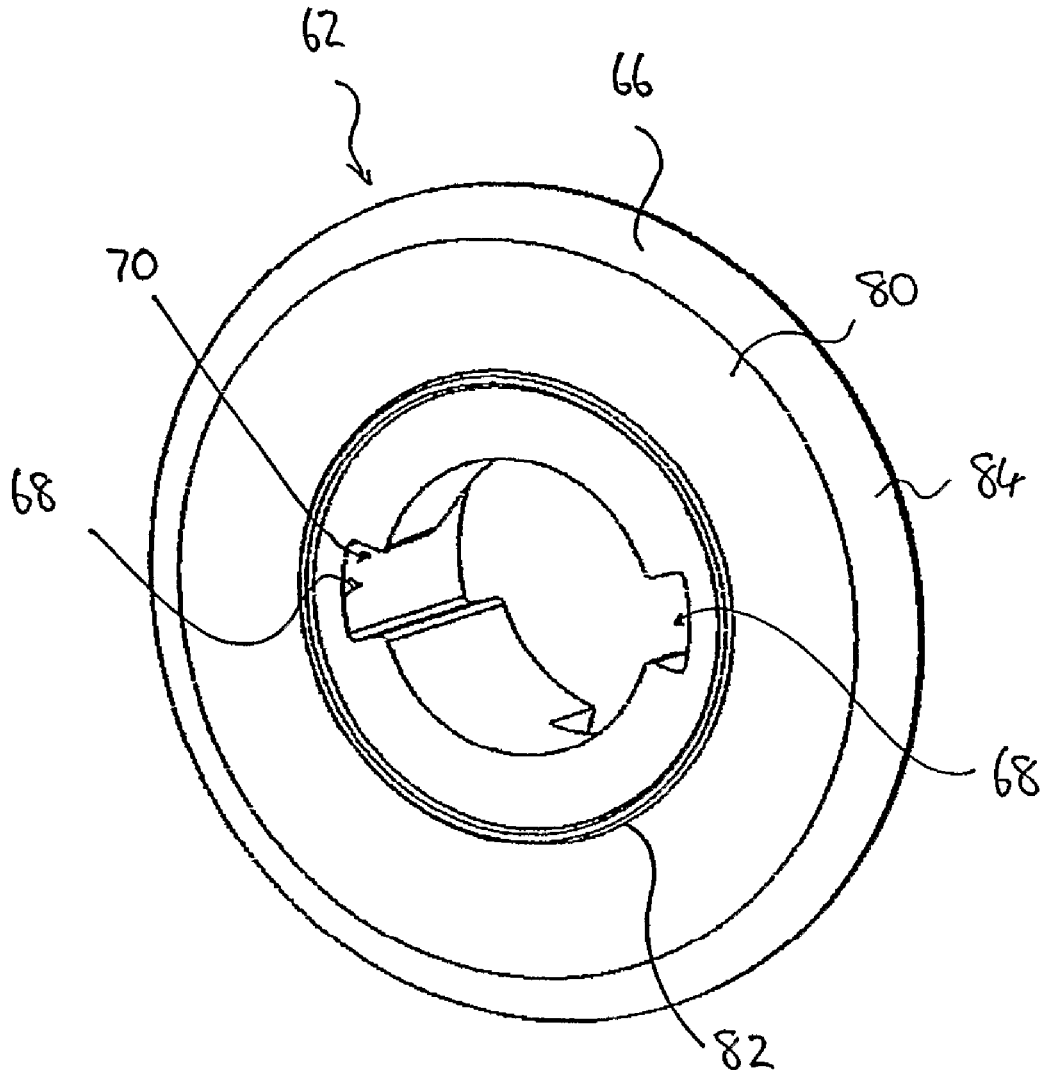
FIG. 10 is a perspective rear view of the fastener.

The diaphragm pump 10 further includes a twist and lock fastener 62 which engages the diaphragm 34 with the connecting member 40. As best seen in FIGS. 4, 9 and 10, the fastener 62 includes a generally cylindrically shaped tubular portion 64 for receiving the spigot 46, and a diaphragm flange 66 extending radially outwardly from one end of, and around, the tubular portion 64.

The tubular portion 64 of the fastener 62 includes two symmetrically opposite tracks 68 formed in a bore of the tubular portion 64, and shaped to receive the wing elements 60 of the spigot 46 of the connecting member 40. Each track 68 includes a short channel 70 which extends into the bore of the tubular portion 64, in parallel with the cylindrical axis of the tubular portion 64, from the edge of the tubular portion 64 adjacent the diaphragm flange 66. The short channel 70 includes a generally dovetailed lateral cross-sectional shape, dimensioned to complementarily match the dovetail shape of the wing element 60 of the connecting member spigot 46. A short sharply inclined cam surface 72 leads off from the channel 70, partway along the bore and in a generally circumferential direction. A longer shallowly inclined cam surface 74 follows contiguously on from the sharply inclined cam surface 72, and a locking recess 76 is formed contiguously with the shallowly inclined cam surface 74 to provide a step back towards the diaphragm flange 66.

An outer surface of the tubular portion 64 of the fastener 62 includes spaced splines 78 or other gripping elements by which a tool, such as a spanner, pliers or a lockable wrench such as a "Mole" grip, or alternatively if of sufficient strength, a user's fingers can grip and twist the fastener 62.

A rear face 80 of the diaphragm flange 66 of the twist and lock fastener 62 includes an arcuate, typically ring shaped, sealing ridge 82, similar to the ridges 56 on the rear face 54 of the diaphragm 34.

The rear face 80 of the diaphragm flange 66 of the fastener 62 includes a smoothly radiused perimeter edge 84 to prevent abrasion and chafing of the diaphragm 34.

With the ring clamp 20 released and the cover 16 removed, the diaphragm 34 is placed into the diaphragm housing 12, and the spigot 46 of the connecting member 40 is received in the diaphragm aperture 58. The perimeter edge 38 of the diaphragm 34 is located on the perimeter flange 32 of the diaphragm housing 12. The twist and lock fastener 62 is offered up to the spigot 46, so that the dovetailed wing elements 60 are received in the dovetailed channels 36 of the tracks 68. The diaphragm 34 is thus sandwiched between the diaphragm flange 66 of the fastener 62 and the diaphragm plate 44 of the connecting member 40. With the dovetailed wing elements 60 received in the dovetailed channels 36 of the tracks 68, the fastener 62 is positively located on the spigot 46.

As the fastener 62 is pushed further onto the spigot 46 and hard against the diaphragm 34, the wing elements 60 leave the short channels 70. At this point, the fastener 62 is twisted, in this case, in a clockwise direction, so that the wing elements 60 ride up the sharply inclined cam surfaces 72 and pass onto the shallowly inclined cam surfaces 74 of the tracks 68. As twisting of the fastener 62 continues, the wing elements 60 travel along the respective shallowly inclined cam surfaces 74, thus further compressing the diaphragm 34 between the diaphragm flange 66 of the fastener 62 and the diaphragm plate 44 of the connecting member 40, before finally dropping into the locking recesses 76. The wing elements 60 are thus positively located in the locking recesses 76 due to the diaphragm 34 being placed under compression by the fastener 62, and the diaphragm 34 is liquid-tightly clamped by the fastener 62 to the diaphragm plate 44 of the connecting member 40.

The ridges 56 and 82 on the rear faces 54 and 80 of the fastener 62 and the diaphragm 34 result in the formation of a tortuous path, and localised increased sealing compression forces on the diaphragm, thereby further preventing or limiting the possibility of liquid passing between the fastener 62 and the diaphragm 34.

To release the twist and lock fastener 62, the tubular portion 64 is gripped and the fastener 62 is turned anti-clockwise. The wing elements 60 are forced out of the locking recesses 76, and thus travel back along the tracks 68 until the fastener 62 can be slidably removed from the spigot 46. The diaphragm 34 can then be easily lifted away from the diaphragm housing 12 for maintenance or replacement.

The spigot of the connecting member can have the tracks, and the fastener can have the wing elements. In this case, the tracks are formed in the exterior surface of the spigot, and the wing elements project radially inwardly.

The spigot and the fastener can each include a wing element and a track. However, this is less convenient, since orientation of the fastener relative to the spigot is fixed.

Since the fastener has no screw-threads for engagement with the connecting member, flat or cross-bladed tools, such as screw-drivers, are no longer required. It is thus far easier to access the diaphragm pump and, with a twist and lock fastener, it is simple to remove and replace the diaphragm. Due to the relatively large size of the fastener, it is also far more unlikely that the fastener will be lost. It is thus also easier to relocate the fastener on the spigot, particularly when the installer cannot see the installation directly and is working by feel alone.

The embodiments described above are given by way of examples only, and further modifications will be apparent to persons skilled in the art without departing from the scope of the invention as defined by the appended claims. For example, only a single wing element and corresponding track can be provided, or more than two wing elements and respective tracks can be provided.

The invention claimed is:

1. A diaphragm pump for a pumped shower waste, the pump comprising:

a diaphragm housing, a diaphragm removably held in the diaphragm housing, the diaphragm having a diaphragm aperture;

an openable cover on the diaphragm housing for accessing the diaphragm, an electric motor, a connecting member positioned in the diaphragm housing and movable by the electric motor, the connecting member having a body, a diaphragm-contacting plate at one end of the body, and a spigot formed centrally on the diaphragm-contacting plate which projects away from the body and is receivable in the diaphragm aperture; and a non-screw-threaded twist and lock fastener having a generally tubular shaped portion with gripping elements on an outer surface thereof and a diaphragm flange extending radially outwardly from the tubular portion, the spigot of the connecting member being receivable in the tubular shaped portion, whereby the fastener releasably engages and liquid-tightly clamps the diaphragm between the diaphragm flange and the diaphragm plate of the connecting member wherein one of the fastener and connecting member includes at least one radially extending wing element and the remaining one of the fastener and connecting member includes a locking recess for receiving and releasably retaining the wing element so as to enable releasable inter-engagement of the fastener and the connecting member by rotation of the tubular portion in an appropriate direction.

2. A diaphragm pump as claimed in claim 1, wherein the said at least one wing element is formed on the connecting member, and the locking recess is formed in the fastener.

3. A diaphragm pump as claimed in claim 1, wherein the fastener includes a cam surface along which the wing element can travel before locating in the locking recess.

4. A diaphragm pump as claimed in claim 1, wherein the said at least one wing element projects outwardly from the spigot.

5. A diaphragm pump as claimed in claim 1, wherein two wing elements and two locking recesses are provided.

6. A diaphragm pump as claimed in claim 1, wherein the twist and lock fastener and/or the diaphragm includes one or more arcuate sealing ridges for forming a tortuous path between the fastener and the diaphragm to prevent or limit passage of liquid there between.

7. A diaphragm pump as claimed in claim 6, wherein the or each sealing ridge projects in a direction which is parallel with a rotational axis of the fastener.

8. A diaphragm pump as claimed in claim 6, wherein the or each sealing ridge is a continuous ring.

9. A diaphragm pump as claimed in claim 1, wherein the diaphragm during use is sandwiched between the twist and lock fastener and the connecting member.

* * * * *